United States Patent [19]

La Clair

[11] 4,401,448

[45] Aug. 30, 1983

[54] AIR SEPARATION PROCESS FOR THE PRODUCTION OF KRYPTON AND XENON

[75] Inventor: Louis M. La Clair, Grand Island, N.Y.

[73] Assignee: Union Carbide Corporation, Danbury, Conn.

[21] Appl. No.: 381,465

[22] Filed: May 24, 1982

[51] Int. Cl.[3] ..... F25J 3/02

[52] U.S. Cl. ..... 62/22; 55/66; 423/262

[58] Field of Search ..... 62/22; 55/66; 176/37; 423/262

[56] References Cited

U.S. PATENT DOCUMENTS

| | | | |
|---|---|---|---|
| 2,040,108 | 5/1936 | Schlitt | 62/22 |
| 2,101,300 | 12/1937 | Weil | 62/22 |
| 3,596,471 | 8/1971 | Streich | 62/22 |
| 3,609,983 | 10/1971 | Lofredo et al. | 62/22 |
| 3,751,934 | 8/1973 | Frischbier | 62/41 |
| 3,768,270 | 10/1973 | Schuftan | 62/31 |
| 3,779,028 | 12/1973 | Schuftan et al. | 62/22 |

*Primary Examiner*—Frank Sever

*Attorney, Agent, or Firm*—Stanley Ktorides

[57] ABSTRACT

An air separation process which safely and efficiently produces krypton and xenon by concentrating these rare gases in nitrogen and in a manner such that the performance of the associated main air separation plant is minimally impacted.

10 Claims, 1 Drawing Figure

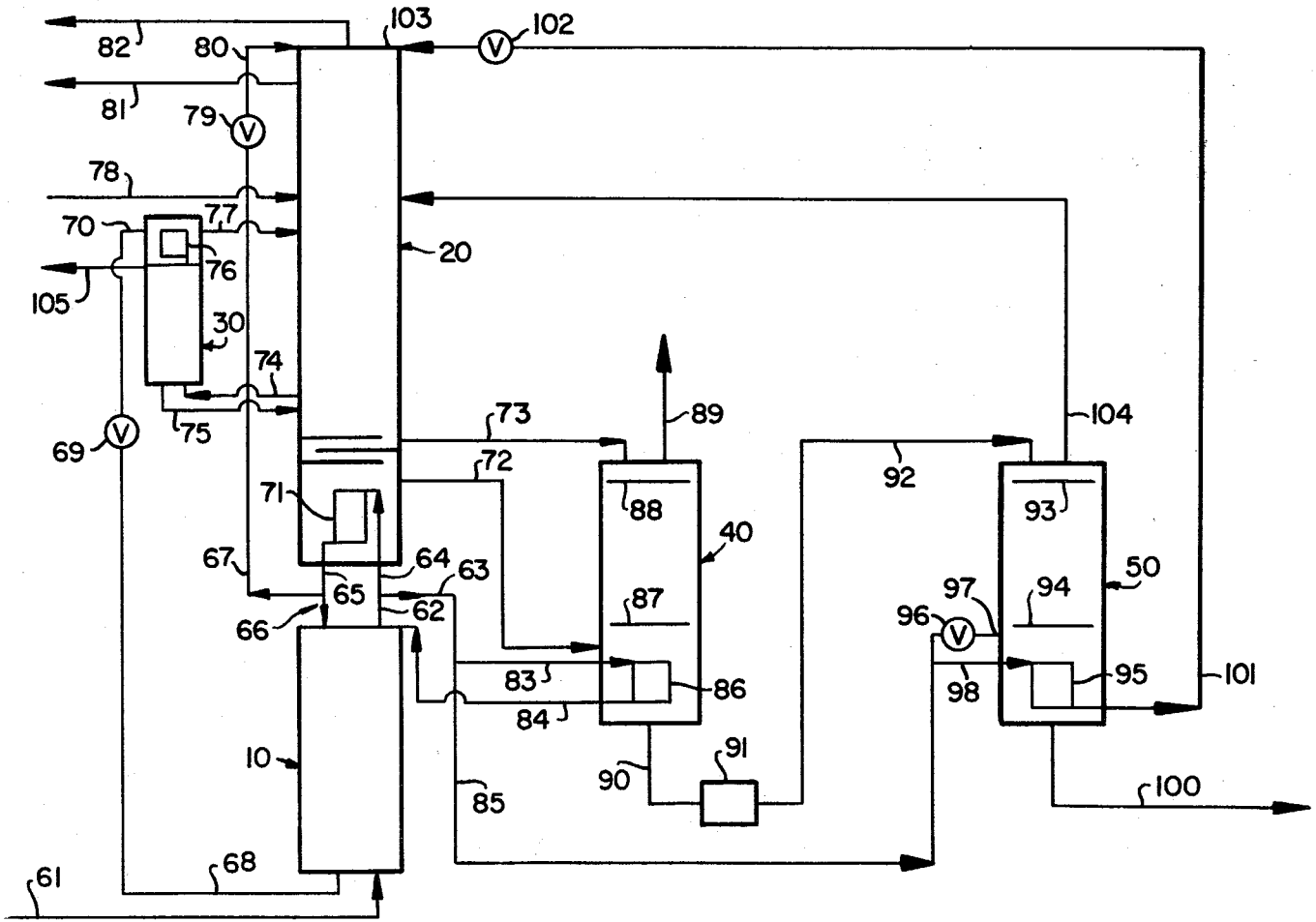
101
100
50
95
104
93
94
97
98
96
92
40
86
91
89
88
87
90
102
73
72
83
84
85
20
63
64
62
103
65
71
66
10
74
67
68
80
79
77
76
30
75
82
81
78
70
105
69
61

AIR SEPARATION PROCESS FOR THE PRODUCTION OF KRYPTON AND XENON

DESCRIPTION

1. Technical Field

This invention relates generally to the cryogenic separation of air by rectification to produce gases and specifically to the production of krypton and xenon.

2. Background Art

Krypton and xenon gases have recently seen an increase in their demand due, in part, to the increase in the price of energy. Krypton is now being used as a filler gas for electric light bulbs to increase their efficiency and as insulation for such uses as double glazed windows. Xenon has been employed in improved x-ray devices.

The principal source of krypton and xenon is the atmosphere. Atmospheric air contains about 1.1 ppm of krypton and about 0.09 ppm of xenon. Generally, krypton and xenon are recovered from the air in conjunction with a comprehensive air separation process which separates air into such components as oxygen, nitrogen and argon.

A number of comprehensive air separation processes which additionally recover krypton and xenon are known. However, all such known processes are deficient in one or more aspects such as efficiency or safety.

For example, one known process employs a side column with the conventional double column air separation plant wherein krypton and xenon are concentrated in liquid oxygen which is then flash-vaporized and passed through an adsorbent to recover the rare gases. Disadvantages to this system include the safety problem which occurs when the adsorbent is regenerated by warming due to the retention of some oxygen and hydrocarbon by the adsorbent. Another disadvantage is the use of feed air to drive the bottom reboiler of the side column which results in an operating burden on the main air separation plant.

Another known process is described in U.S. Pat. No. 3,751,934—Frischbier. This process returns descending liquid in a side column to the main air separation plant main condenser and thus avoids the need to reboil the bottoms of the side column with condensing feed air. However, this process increases the hydrocarbon concentration of the main air separation plant oxygen liquid and thus creates a significantly increased safety hazard.

Still another known process is described in U.S. Pat. No. 3,596,471—Streich. This process concentrates krypton and xenon in a liquid oxygen stream and then exchanges the oxygen with argon in an exchange column. The argon is supplied from an argon section of the main air separation plant. This process has the disadvantage of tying the rare gas recovery with the notoriously sensitive argon section; often this results in an undesirable impact upon argon recovery.

At the heart of krypton and xenon recovery processes is the fact that krypton and xenon have lower vapor pressures than the major atmospheric gases. This allows their concentration, in a vapor-liquid countercurrent distillation process, to increase to the point where recovery is economically viable. Unfortunately these processes also unavoidably concentrate atmospheric hydrocarbons which are also characterized by lower vapor pressures than the major atmospheric gases, thus giving rise to an increased danger of explosion. A process which will allow effective recovery of krypton and xenon from the atmospheric air, avoid the safety danger posed by increased hydrocarbon concentration and not place an operating penalty on the main air separation plant would be highly desirable.

Accordingly, it is an object of this invention to provide an improved process to produce krypton and xenon from the atmospheric air.

It is another object of this invention to provide a process to produce krypton and xenon from the atmospheric air which is compatible with conventional air separation processes which separate air into products such as oxygen, nitrogen or argon.

It is another object of this invention to provide a process to produce krypton and xenon from the atmospheric air while not imposing an operating penalty upon the main air separation plant.

It is still another object of this invention to provide a process to produce krypton and xenon from the atmospheric air while substantially avoiding the increased danger caused by hydrocarbon concentration.

DISCLOSURE OF INVENTION

The above and other objects which will become apparent to one skilled in the art are achieved:

In a process for the separation of air wherein air at greater than atmospheric pressure is subjected to rectification in a high pressure column and a low pressure column which are in heat exchange relation at a heat exchange stage, the improvement, whereby a fraction containing a relatively high concentration of krypton and xenon is produced, comprising:

(a) introducing a gaseous oxygen-rich stream, containing krypton and xenon, taken from the low pressure column above said heat exchange stage, into a rare gas stripping column provided with a first bottom reboiler;

(b) introducing a liquid oxygen-rich stream, taken from the low pressure column at a point above that from which said gaseous oxygen-rich stream is taken, into the rare gas stripping column as descending liquid reflux in an amount such that the reflux ratio of the rare gas stripping column is from 0.1 to 0.3;

(c) stripping krypton and xenon from the gaseous oxygen-rich stream into the descending liquid reflux;

(d) partially vaporizing the liquid reflux in the first reboiler by indirect heat exchange with a first condensing gaseous nitrogen-rich stream taken from the high pressure column;

(e) returning the resulting condensed nitrogen-rich stream from step (d) into either the high pressure column or the low pressure column;

(f) recovering from the rare gas stripping column a liquid first rare gas stream comprising krypton, xenon and oxygen wherein krypton and xenon are in a concentration greater than their concentration in the descending liquid reflux;

(g) introducing said liquid first rare gas stream into an oxygen exchange column provided with a second bottom reboiler;

(h) introducing a gaseous nitrogen stream, taken from the high pressure column, into the oxygen exchange column in an amount such that the reflux ratio of the oxygen exchange column is from 0.15 to 0.35;

(i) passing in said oxygen exchange column said liquid first rare gas stream against said gaseous nitrogen stream such that oxygen in the liquid first rare gas stream is replaced by nitrogen;

(j) withdrawing the resulting oxygen-containing gaseous nitrogen-rich stream of step (i) from the oxygen exchange column and introducing it into the low pressure column;

(k) partially vaporizing the resulting nitrogen-containing liquid first rare gas stream of step (i) in the second reboiler by indirect heat exchange with a second condensing gaseous nitrogen-rich stream taken from the high pressure column;

(l) returning the resulting condensed nitrogen-rich stream of step (k) into either the low pressure column or the high pressure column; and (m) recovering a liquid second rare gas stream comprising krypton, xenon and nitrogen wherein krypton and xenon are in a concentration greater than their concentration in the liquid first rare gas stream.

The term, column, is used to mean a distillation or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of distillation columns see the Chemical Engineers' Handbook, Fifth Edition, edited by R. H. Perry and C. H. Chilton, McGraw-Hill Book Company, New York, Section 13, "Distillation" B. D. Smith et al, page 13-3, *The Continuous Distillation Process.*

The term, double column, is used to mean a high pressure column having its upper end in heat exchange relation with the lower end of a low pressure column. An expanded discussion of double columns appears in *Ruheman* "The Separation of Gases" Oxford University Press, 1949, Chapter VII, Commercial Air Separation, and *Barron*, "Cryogenic Systems", McGraw-Hill, Inc., 1966, p. 230, Air Separation Systems.

The term, stripping column, is used to mean a column that concentrates krypton and xenon in oxygen.

The term, exchange column, is used to mean a column that replaces oxygen in a krypton-xenon concentrate with nitrogen.

The term, reflux ratio, is used to mean the numerical ratio of descending liquid and rising vapor flow in a column.

The terms, bottom reboiler or bottom condenser, are used to mean the heat exchanger used to vaporize at least part of the descending liquid at the bottom of a column.

The term, equilibrium stage, is used to mean a vapor-liquid contacting stage whereby the vapor and liquid leaving that stage are in mass transfer equilibrium. The separating capability of actual plates or packing height in a column can be specified in terms of number of equilibrium stages.

BRIEF DESCRIPTION OF THE DRAWING

FIG. 1 is a schematic representation of one preferred embodiment of the process of this invention.

DETAILED DESCRIPTION

The process of this invention will be described in general with reference to FIG. 1 which is a schematic representation of a process wherein oxygen, nitrogen and argon are produced in a main air separation plant in addition to krypton and xenon in additional columns. The conventional and well known double column arrangement with an argon side column will be described first. This is a typical double column distillation system wherein air is fed to a high pressure column in which the initial separation is carried out and which is in heat exchange relation with a low pressure column, to which air may also be fed and in which a further separation is carried out. Although such double distillation column systems may operate under a great range of pressure conditions depending, for example, on the purity of the products sought, generally the low pressure column operates at a pressure of from 15 to 30 psia and the high pressure column operates at a pressure of from about 90 to 150 psia.

Feed air 61 at greater than atmospheric pressure is introduced into the high pressure column 10 where it is separated into oxygen-enriched and nitrogen-enriched fractions. The rising nitrogen-enriched vapor 62 passes at 64 to the main condenser 71 located in the low pressure column 20 where it is condensed and passed 65 as liquid reflux into the high pressure column at 66 while a fraction 67 is passed through expansion valve 79 and passed as liquid reflux into the low pressure column at 80. The descending liquid reflux in the high pressure column is removed as an enriched oxygen liquid stream 68 and passed through expansion valve 69 as liquid reflux at 70 into argon column 30.

The liquid stream 70 is partially vaporized in heat exchanger 76 and this partially vaporized stream 77 is fed into the low pressure column. A vapor stream 74, taken from a lower point on the low pressure column than where stream 77 is fed, is introduced into the argon column 30 which separates the feed into crude argon product 105 and liquid stream 75 which is returned to the low pressure column. Also introduced into the low pressure column is stream 78 which is a low pressure air feed stream. This stream can be that portion of the plant feed air which may be utilized to develop plant refrigeration. The air desuperheater section normally used to cool and clean the feed air against return product and waste streams is not shown but can be any of the well-known arrangements such as those described in the Ruheman and Barron references.

The low pressure column separates all the incoming streams into waste nitrogen 81, product nitrogen 82, if desired, and if desired, product oxygen, which is not shown but may be taken from the low pressure column just above the main condenser 71.

As mentioned previously, these process steps for the main plant are generally well known and although there may be a number of minor variations pertaining to, for example, heat exchange between the columns, the general process steps described may be found in a number of commercial operations. There now follows a detailed description of the improvement of this invention.

A stream of oxygen-enriched gas 72, which contains krypton and xenon, is taken from the low pressure column above the main condenser 71 and introduced into the stripping column 40. Stream 72 is preferably taken from immediately above main condenser 71 and preferable introduced below the bottom tray 87 of the stripping column 40.

A stream of liquid oxygen-rich reflux from the low pressure column is taken from above the point from which gaseous oxygen-rich stream 72 is taken and fed 73 into the rare gas stripping column 40, preferably to the top tray 88. The liquid stream 73 is preferably taken from about one to five equilibrium stages (typically one to five actual plates) above the main condenser 71 and most preferably it is taken from the third equilibrium stage (typically the third plate) above the main condenser 71. The rare gas stripping column will generally operate at about the pressure at which the low pressure column operates although there may be some pressure drop associated with the flow lines.

The stream are introduced into the stripping column and the column is operated such that the column reflux ratio is from 0.1 to 0.3, preferably from 0.15 to 0.25, most preferably about 0.2. A reflux ratio within this range is required in order to concentrate a substantial portion of the available krypton and xenon in the liquid bottoms while assuring that a significant amount of hydrocarbons, especially methane, are removed with the gaseous stream 89.

The stripping column serves to strip virtually all of the krypton and xenon from the gaseous stream to the liquid. Gaseous product oxygen 89 is removed from the top of the stripping column. The liquid is partially vaporized in the bottom of the column by heat exchange with condensing vapor in bottom reboiler or bottom condenser 86. The reboiler 86 is driven by high pressure nitrogen-rich vapor 83 which is taken from stream 63, which itself is split off from stream 62. The condensate 84 from the reboiler 86 is returned as liquid reflux; although it may be returned to either the low or high pressure column, it is preferably returned to the high pressure column as at 84.

The use of a nitrogen stream rather than, for example, feed air to drive the reboiler 86 is advantageous because the main plant can make optimum use of the higher quality liquid nitrogen as reflux rather than being deprived of it while having to use liquid air as reflux.

The partial vaporization of the stripping column descending liquid serves to further concentrate the krypton and xenon in the liquid phase due to their lower vapor pressures than oxygen. The liquid stream, or first rare gas stream, which at this point will generally have a krypton content of at least 250 ppm, is removed from the stripping column at 90 and it is optionally, but preferably, passed through an adsorbent trap 91, such as silica gel, to remove contaminants. Generally, liquid outgoing stream 90 is about 5 to 10 percent, preferably about 7 percent, of liquid incoming stream 73 on a volumetric flow rate basis.

After passing through trap 91, the first rare gas stream 92 is introduced into exchange column 50, preferably at the top tray 93. The exchange column will generally operate at about the pressure at which the low pressure column operates although there may be some pressure drop associated with the flow lines. Nitrogen vapor 85 from the high pressure column 10 is passed through expansion valve 96 and introduced at 97 into the exchange column 50 below the bottom tray 94. The streams are introduced into exchange column 50 such that the reflux ratio is from 0.15 to 0.35, preferably from 0.2 to 0.3, most preferably about 0.24. The rising nitrogen vapor is contacted within the column with the descending liquid introduced at the top and by this action oxygen in the liquid is stripped from the liquid into the gas while nitrogen replaces oxygen in the liquid.

The liquid which descends to the bottom of the exchange column is partially vaporized by indirect heat exchange with condensing vapor in bottom reboiler or bottom condenser 95. The reboiler 95 is driven by high pressure nitrogen vapor 98. The condensate from the reboiler 95 is returned 101 as liquid reflux; although it may be returned to either the low or high pressure column, it is preferably returned to the low pressure column at 103 after passing through expansion valve 102. Thus, the advantages of avoiding the use of air to drive the reboiler, as described previously when discussing the operation of stripping column 40, are also attained by this operation of exchange column 50.

The partial vaporization at the bottom of exchange column 50 further concentrates the krypton and xenon in the liquid due to their lower vapor pressures relative to the other components. The rare gas-containing liquid is removed from the exchange column as second rare gas stream 100. This stream 100 will generally have a krypton concentration of about at least 0.5 mole percent. Stream 100 will generally be from about 1 to about 5 percent, preferably about 3 percent on a volumetric flow rate basis of incoming liquid stream 92. The greater part of crude product stream 100 is composed of nitrogen which is inert to combustion thus alleviating the safety problem which would arise if krypton and xenon, which unavoidable are recovered in association with significant amounts of hydrocarbons, were recovered in a stream comprising a large portion of oxygen.

The rising gas, into which most of the incoming oxygen has been transferred, is removed from the top of the column as stream 104. Preferably it is returned to the low pressure column 20 so that the oxygen and other components of the stream are not lost but are recycled within the air separation system.

Typical process conditions for the process of this invention are tabulated in Tables I and II. Table I summarizes a computer simulation of the operation of the stripping column and Table II summarizes a computer simulation of the operation of the exchange column. The stream and tray numbers in the tables correspond to those of FIG. 1. The stream flows are expressed as mcfh, i.e., thousands of cubic feet per hour measured at standard conditions of 70° F. and one atmosphere, and purity is expressed either as mole percent or parts per million (ppm).

As can be seen from Table I a large amount of the hydrocarbons in the system are removed in stream 89 with little loss of krypton and virtually no loss of xenon. Furthermore the data shown in Tables I and II demonstrate that the krypton and xenon concentrations in the first liquid rare gas stream (streams 90 or 92) exceed the concentrations in the stripping column reflux (stream 73), that the krypton and xenon contrations in the second liquid rare gas stream (crude product stream 100) exceed the concentrations in the first liquid rare gas stream, and that the crude product stream 100 is composed primarily of non-combustible nitrogen and contains very little oxygen.

TABLE I

| PROCESS CONDITIONS FOR STRIPPING COLUMN | |
|---|---|
| Liquid Oxygen Reflux | |
| Stream No. | 73 |
| Flow, mcfh | 408 |
| Purity | |
| Oxygen, % | 99.2 |
| Argon, % | 0.8 |
| Krypton, ppm | 2.5 |
| Xenon, ppm | 0.14 |
| Hydrocarbons, ppm | 5.1 |

TABLE I-continued

| PROCESS CONDITIONS FOR STRIPPING COLUMN | |
|---|---|
| Oxygen Gas | |
| Stream No. | 72 |
| Flow, mcfh | 1666 |
| Purity | |
| Oxygen, % | 99.6 |
| Argon, % | 0.4 |
| Krypton, ppm | 8.6 |
| Xenon, ppm | 0.53 |
| Hydrocarbons, ppm | 14.2 |
| Oxygen Gas Product | |
| Stream No. | 89 |
| Flow, mcfh | 2040 |
| Purity | |
| Oxygen, % | 99.5 |
| Argon, % | 0.5 |
| Krypton, ppm | 0.35 |
| Xenon, ppm | — |
| Hydrocarbons, ppm | 9 |
| Liquid From Bottom Tray | |
| Tray No. | 87 |
| Flow. mcfh | 405 |
| Purity | |
| Oxygen, % | 99.7 |
| Argon, % | 0.3 |
| Krypton, ppm | 224 |
| Xenon, ppm | 2.5 |
| Hydrocarbons, ppm | 210 |
| Rare Gas Liquid Concentrate | |
| Stream No. | 90 |
| Flow, mcfh | 34 |
| Purity | |
| Oxygen, % | 99.7 |
| Argon, % | 0.3 |
| Krypton, ppm | 427 |
| Xenon, ppm | 27.4 |
| Hydrocarbons, ppm | 216 |

TABLE II

| PROCESS CONDITIONS FOR EXCHANGE COLUMN | |
|---|---|
| Rare Gas Liquid Concentrate | |
| Stream No. | 92 |
| Flow, mcfh | 34 |
| Purity | |
| Oxygen, % | 99.7 |
| Argon, % | 0.3 |
| Krypton, ppm | 427 |
| Xenon, ppm | 27.4 |
| Hydrocarbons, ppm | 216 |
| Overhead Return Gas | |
| Stream No. | 104 |
| Flow, mcfh | |
| Purity | |
| Nitrogen, % | 76 |
| Oxygen, % | 24 |
| Krypton, ppm | 25.1 |
| Xenon, ppm | 0.22 |
| Hydrocarbons, ppm | 30 |
| Liquid From Bottom Tray | |
| Tray No. | 94 |
| Flow, mcfh | 45 |
| Purity | |
| Nitrogen, % | 98.8 |
| Oxygen, % | 1.1 |
| Krypton, ppm | 488 |
| Xenon, ppm | 25.4 |
| Hydrocarbons, ppm | 369 |
| Crude Rare Gas Product | |
| Stream No. | 100 |
| Flow, mcfh | 1 |
| Purity | |
| Nitrogen, % | 97.5 |
| Oxygen, % | 1.0 |
| Krypton, ppm | 11000 |
| Xenon, ppm | 900 |

TABLE II-continued

| PROCESS CONDITIONS FOR EXCHANGE COLUMN | |
|---|---|
| Hydrocarbons, ppm | 3200 |

By the use of the process of this invention wherein krypton and xenon are successively concentrated in a stripping column and an exchange column, each operating within defined reflux ratios in order to efficiently perform the required mass transfer operations, and each reboiling bottoms so as to effectively concentrate the krypton and xenon, each reboiler driven by high pressure nitrogen-rich vapor to minimize the main plant burden, and wherein the krypton and xenon are recovered in a stream composed primarily of nitrogen so that combustion hazards during further transport and processing, such as in a refinery, are minimized, one can more efficiently and safely produce krypton and xenon by cryogenic separation of the atmospheric air.

Although the process of this invention has been described in detail with regard to the embodiment illustrated in FIG. 1, it is understood that the process of this invention encompasses many variations from the specific process which is illustrated and described in detail.

I claim:

1. In a process for the separation of air wherein air at greater than atmospheric pressure is subjected to rectification in a high pressure column and a low pressure column which are in heat exchange relation at a heat exchange stage, the improvement, whereby a fraction containing a relatively high concentration of krypton and xenon is produced, comprising:

(a) introducing a gaseous oxygen-rich stream, containing krypton and xenon, taken from the low pressure column above said heat exchange stage, into a rare gas stripping column provided with a first bottom reboiler;

(b) introducing a liquid oxygen-rich stream, taken from the low pressure column at a point above that from which said gaseous oxygen-rich stream is taken, into the rare gas stripping column as descending liquid reflux in an amount such that the reflux ratio of the rare gas stripping column is from 0.1 to 0.3;

(c) stripping krypton and xenon from the gaseous oxygen-rich stream into the descending liquid reflux;

(d) partially vaporizing the liquid reflux in the first reboiler by indirect heat exchange with a first condensing gaseous nitrogen-rich stream taken from the high pressure column;

(e) returning the resulting condensed nitrogen-rich stream from step (d) into either the high pressure column or the low pressure column;

(f) recovering from the rare gas stripping column a liquid first rare gas stream comprising krypton, xenon and oxygen wherein krypton and xenon are in a concentration greater than their concentration in the descending liquid reflux;

(g) introducing said liquid first rare gas stream into an oxygen exchange column provided with a second bottom reboiler;

(h) introducing a gaseous nitrogen stream, taken from the high pressure column, into the oxygen exchange column in an amount such that the reflux ratio is from 0.15 to 0.35;

(i) passing in said oxygen exchange column said liquid first rare gas stream against said gaseous nitrogen stream such that oxygen in the liquid first rare gas stream is replaced by nitrogen;

(j) withdrawing the resulting oxygen-containing gaseous nitrogen-rich stream of step (i) from the oxygen exchange column and introducing it into the low pressure column;

(k) partially vaporizing the resulting nitrogen-containing liquid first rare gas stream of step (i) in the second reboiler by indirect heat exchange with a second condensing gaseous nitrogen-rich stream taken from the high pressure column;

(l) returning the resulting condensed nitrogen-rich stream of step (k) into either the low pressure column or the high pressure column; and (m) recovering a liquid second rare gas stream comprising krypton, xenon and nitrogen wherein krypton and xenon are in a concentration greater than their concentration in the liquid first rare gas stream.

2. The process of claim 1 wherein said gaseous oxygen-rich stream of step (a) is taken from immediately above the heat exchange stage.

3. The process of claim 1 wherein said liquid oxygen-rich stream of step (b) is taken from 1 to 5 equilibrium stages above the heat exchange stage.

4. The process of claim 1 wherein the reflux ratio of the rare gas stripping column is from 0.15 to 0.25.

5. The process of claim 1 wherein in step (e) the resulting condensed nitrogen-rich stream of step (d) is returned to the high pressure column.

6. The process of claim 1 wherein the liquid first rare gas stream is passed through a filter before being introduced into the oxygen exchange column.

7. The process of claim 1 wherein the liquid first rare gas stream comrises from 5 to 10 volume percent of the liqud oxygen-rich stream.

8. The process of claim 1 wherein the reflux ratio of the oxygen exchange column is from 0.2 to 0.3.

9. The process of claim 1 wherein in step (l) the resulting condensed nitrogen-rich stream of step (k) is returned to the low pressure column.

10. The process of claim 1 wherein the liquid second rare gas stream comprises from 1 to 5 volume percent of the liquid first rare gas stream.

* * * * *